US008312657B2

(12) United States Patent
Lizarralde Ibarguren

(10) Patent No.: US 8,312,657 B2
(45) Date of Patent: Nov. 20, 2012

(54) MUZZLE-LOADING RIFLE EQUIPPED WITH A GUNPOWDER-PROOF SEALED BREECH PLUG

(75) Inventor: Iñigo Lizarralde Ibarguren, Bergara (ES)

(73) Assignee: Dikar, S. Coop., Bergara, Gipuzkoa (ES)

( * ) Notice: Subject to any disclaimer, the term of this patent is extended or adjusted under 35 U.S.C. 154(b) by 226 days.

(21) Appl. No.: 12/469,232

(22) Filed: May 20, 2009

(65) Prior Publication Data

US 2012/0137558 A1 Jun. 7, 2012

(51) Int. Cl.
*F41C 9/08* (2006.01)

(52) U.S. Cl. ..... 42/51; 89/1.3

(58) Field of Classification Search ..... 42/51; 89/1.3
See application file for complete search history.

(56) References Cited

U.S. PATENT DOCUMENTS

| | | | | |
|---|---|---|---|---|
| 4,222,191 | A | 9/1980 | Lee et al. | |
| 4,232,468 | A * | 11/1980 | Chapin | 42/77 |
| 5,133,143 | A * | 7/1992 | Knight | 42/51 |
| 5,639,981 | A | 6/1997 | French | |
| 5,706,598 | A * | 1/1998 | Johnston | 42/51 |
| 5,782,030 | A | 7/1998 | French | |
| 5,860,240 | A * | 1/1999 | Ball et al. | 42/51 |
| 5,907,920 | A * | 6/1999 | Laney | 42/83 |
| 5,915,934 | A * | 6/1999 | Knight et al. | 42/51 |
| 6,216,380 | B1 * | 4/2001 | McGarity, Jr. et al. | 42/51 |
| 6,311,421 | B1 | 11/2001 | Knight | |
| 6,604,311 | B1 | 8/2003 | Laney et al. | |
| 6,718,677 | B2 * | 4/2004 | Camp | 42/51 |
| 7,140,138 | B1 | 11/2006 | Laney et al. | |
| 7,260,911 | B2 * | 8/2007 | Davis | 42/121 |
| 7,353,631 | B2 * | 4/2008 | Calvete Zumalde | 42/51 |
| 7,526,888 | B1 * | 5/2009 | Joyce | 42/51 |
| 7,621,064 | B2 * | 11/2009 | Laney et al. | 42/51 |
| 7,726,058 | B2 | 6/2010 | Richards | |
| 7,814,694 | B2 * | 10/2010 | Laney et al. | 42/51 |
| 7,954,269 | B2 | 6/2011 | Laney et al. | |
| 2002/0035800 | A1 * | 3/2002 | Lewis | 42/51 |
| 2005/0066566 | A1 * | 3/2005 | Hengstenberg et al. | 42/51 |
| 2006/0086029 | A1 * | 4/2006 | Kirkpatrick | 42/51 |
| 2007/0039222 | A1 * | 2/2007 | Lizarralde et al. | 42/51 |

FOREIGN PATENT DOCUMENTS

EP 0178284 A1 4/1986

* cited by examiner

*Primary Examiner* — Bret Hayes
*Assistant Examiner* — Joshua Freeman
(74) *Attorney, Agent, or Firm* — Gardner Groff Greenwald & Villanueva, PC

(57) ABSTRACT

Muzzle-loading rifle, which comprises a breech plug (1) and a barrel (2), both fixed in a connection area (3), characterized in that the breech plug (1) is provided with a continuous flange (11) that presses from inside against a seating surface (12) of the barrel (2) when the breech plug (1) is fitted in the interior of the barrel (2), so that said pressure increases when the powder (7) explodes on the second end (5) of the breech plug (1). As a result, the seal between the breech plug (1) and the barrel (2) is strengthened and the gunpowder is prevented from reaching the connection area (3), thereby making it easier to detach the breech plug (1).

4 Claims, 2 Drawing Sheets

MUZZLE-LOADING RIFLE EQUIPPED WITH A GUNPOWDER-PROOF SEALED BREECH PLUG

TECHNICAL FIELD

The invention relates to a muzzle-loading rifle (also known as muzzleloader), i.e. a rifle in which the gunpowder and bullet are loaded and pressed into the barrel manually. More particularly, the invention has to do with the breech plug and the barrel of said rifle.

PRIOR ART

A muzzle-loading rifle is a rifle that, in structural and functional terms, replicates old-fashioned, traditional rifles and gives the user the feeling that they are firing an antique weapon in accordance with classical hunting techniques. Specifically, a muzzle-loading rifle is mainly characterised in that the gunpowder and the bullet must be manually inserted into the bottom of the barrel and pressed down before the shot can be fired.

After the gunpowder and the bullet have been pressed into the bottom of the barrel (next to the breech plug), the trigger is pulled, the shot happening as follows: the pulling of the trigger causes an ignition at the end of the breech plug opposite the gunpowder and the bullet. Said ignition travels through a relatively narrow internal conduit of the breech plug until it reaches the other side of the breech plug, reaching the gunpowder. The gunpowder then explodes, causing the bullet to be fired.

After a certain number of shots is performed using these rifles, traces of gunpowder usually collect in the connection area between the breech plug and the barrel (a connection area that is generally threaded although it may present other arrangements). These traces of gunpowder make it very difficult to detach the breech plug from the barrel, so much that in some cases it is impossible to detach the breech plug with the traditional tools the user carries with them. In more extreme cases it is impossible to remove the breech plug without damaging it, even when securing the rifle on work benches and using large levering tools. Bearing in mind that the breech plug must be detached from the barrel every day (so that it may be cleaned carefully in order to remove the traces of gunpowder and other impurities that may block the internal conduit), the difficulty or impossibility of separating both members can cause great inconvenience for the user.

Some solutions are known that attempt to solve this problem. One known solution consists of disposing of one or more elastic mechanized rings (shaped like a very closed C-shape, in other words almost in the form of a complete circle) between the breech plug and the barrel, on the end of the breech plug that is closer to the gunpowder and the bullet, with these rings acting as seals. These solutions may work for low-pressure explosions, but it has been found that they are ineffective with regard to the pressures generated in muzzle-loading rifles: muzzle-loading rifles are set up to use new-generation black gunpowder, which is much more powerful than the gunpowder used traditionally. Firstly, as the rings are not completely circular or closed, it has been found that gunpowder can pass through them and reach the connection area between the breech plug and the barrel. Secondly and above all, it has been found that in spite of the ring there is a small area between the breech plug and the barrel where particles of gunpowder are prone to collect. This space is large enough to cause a "sticking" effect that is just as problematic as the gunpowder reaching the connection area.

It is an objective of the invention to provide a design for a muzzle-loading rifle, more particularly for the rifle's breech plug and barrel, which prevents any gunpowder from passing from the gunpowder explosion area to the connection area between the breech plug and the barrel. Thus, the invention aims to facilitate the disconnection of the breech plug from the barrel as much as possible and enable said disconnection to be carried out manually without the help of any tools whatsoever.

BRIEF DESCRIPTION OF THE INVENTION

In order to achieve the aforementioned objectives the invention proposes a muzzle-loading rifle provided with a breech plug and a barrel, both of them fixed to each other in a connection area, wherein the breech plug comprises a first end further away from the part of the barrel where a bullet is to be housed and a second end closer to said part of the barrel. According to the invention, the second end of the breech plug is provided with a flange that presses internally against a seating surface of the barrel when the breech plug is fitted in the interior of the barrel. Said pressure increases when the gunpowder located near the second end of the breech plug explodes. In other words, the flange expands against the seating surface when the gunpowder explodes, increasing the pressure it exerts on the seating surface and therefore improving the sealing effect.

The flange of the breech plug is continuous, i.e. it does not have any breaks or gaps. Contact between the flange and the seating surface occurs in the area of 360° around the longitudinal axis of the breech plug. This is possible because the flange bends against the seating surface and may thus form a complete ring shape. The continuity enhances the barrier effect against the gunpowder and helps ensure the objectives of the invention are reached.

The invention provides a permanent seal between the breech plug and the barrel thanks to the pressure that the flange always exerts against the seating surface as a result of the breech plug being attached securely (for example, threaded tightly enough) to the barrel. And, above all, it is particularly interesting that because the pressure is exerted from the inside said sealing effect strengthens when the shot is fired, i.e., when the ignition and the powder explosion take place. Therefore, the invention allows achieving a non-constant, adaptive sealing between the breech plug and the barrel, said sealing being greatest when most needed: during the explosion and expansion of the gunpowder.

As a result, no gunpowder whatsoever is able to pass through to the connection area between the breech plug and the barrel (this has been tested in trials producing results that were in fact surprising). The effect is so positive that the breech plug may be manually and softly detached after several shots, with no effort at all.

BRIEF DESCRIPTION OF THE DRAWINGS

Details of the invention can be seen in the accompanying non-limiting figures.

DETAILED DESCRIPTION OF THE INVENTION

Figure 1:
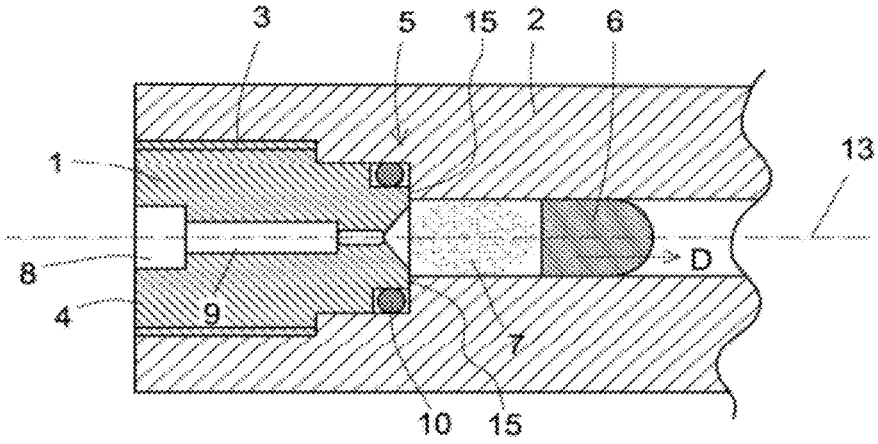
FIG. 1 shows a cross-section of a conventional muzzle-loading rifle, in particular the area of the rifle in which the breech plug is located inside the barrel.

FIG. 1 shows a cross-section of a conventional muzzle-loading rifle, in particular the area of the rifle in which the breech plug (1) is located inside the barrel (2). In the rifle shown in the figure the breech plug (1) is fixed to the barrel (2) by means of a threaded connection area (3). The breech plug (1) comprises a first end (4) and a second end (5). A bullet (6) is also shown housed inside the barrel (2) in front of a certain amount of gunpowder (7). As seen, the first end (4) is the end of the breech plug (1) further from the bullet (6), whereas the second end (5) is the end closer to the bullet (6).

In the rifle shown in the figure the shot occurs as follows. Firstly, an ignition occurs in the chamber (8) in the first end (4) of the breech plug (1). Said ignition travels along an internal conduit (9) of the breech plug (1) until it reaches the second end (5) of the breech plug (1). When the ignition reaches the gunpowder (7) an explosion occurs, causing the bullet (6) to be fired in the shot direction (D). The explosion of the gunpowder (7) also results in some traces of gunpowder being projected through gaps between the outer walls of the breech plug (1) and the inner walls of the barrel (2) towards the connection area (3), potentially blocking it. To prevent this some manufacturers provide the rifle with an elastic mechanized ring (10) that acts as a seal between the area where the gunpowder (7) is located and the connection area (3). It has been found that this elastic mechanized ring (10)—and other similar solutions using seals—largely prevent the passage of gunpowder to the connection area (3). However, in this and other similar solutions it has been found that the gunpowder collects in a small area (15) between the breech plug (1) and the barrel (2), which is sufficiently large to cause a "sticking" effect that is just as problematic as the gunpowder reaching the connection area (3).

Figure 2:
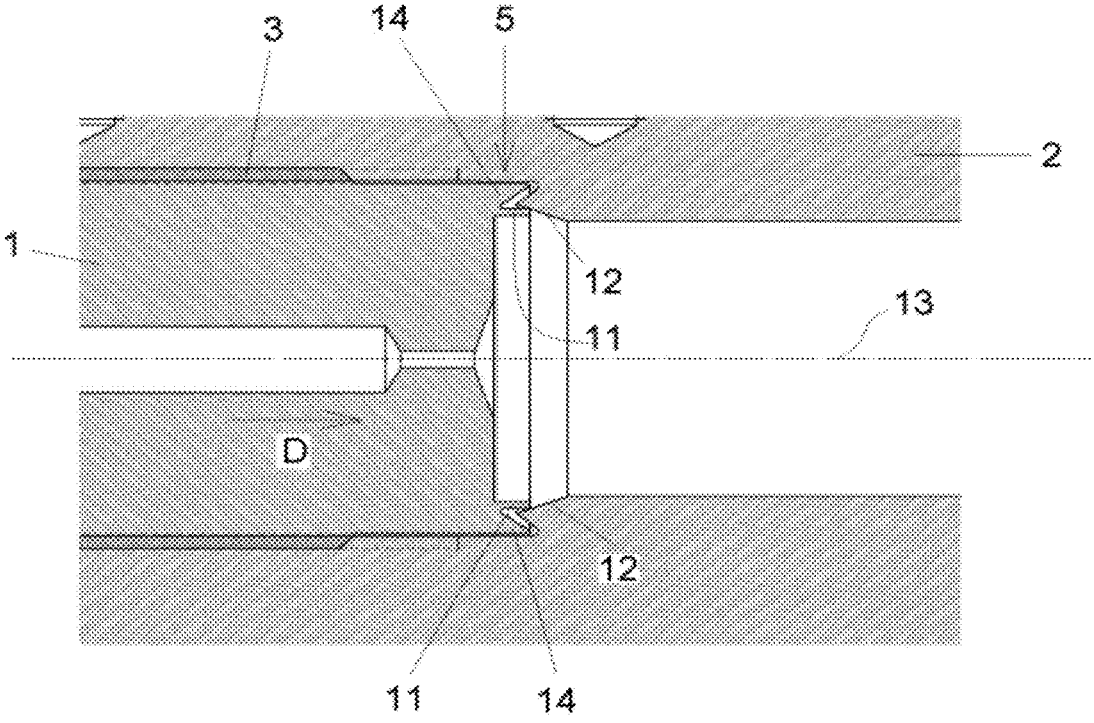
FIG. 2 shows a cross-section of an embodiment of the invention.

FIG. 2 shows a similar view to that of FIG. 1, in this case showing an embodiment of the invention. The rifle shown in the figure also comprises a breech plug (1) and a barrel (2), fixed to each other in a connection area (3). In the rifle according to the invention, the second end (5) of the breech plug (1) is provided with a flange (11) that presses against a seating surface (12) of the barrel (2) when the breech plug (1) is fitted inside the barrel (2). In other words, in the case of the figure where the connection area (3) is threaded, when the breech plug is threaded (1) into the barrel (2) the flange (11) is pressed and tightened against said seating surface (12), creating a seal between both parts (1, 2). The breech plug (11) of the breech plug (1) is continuous along its full perimeter.

Figure 3:
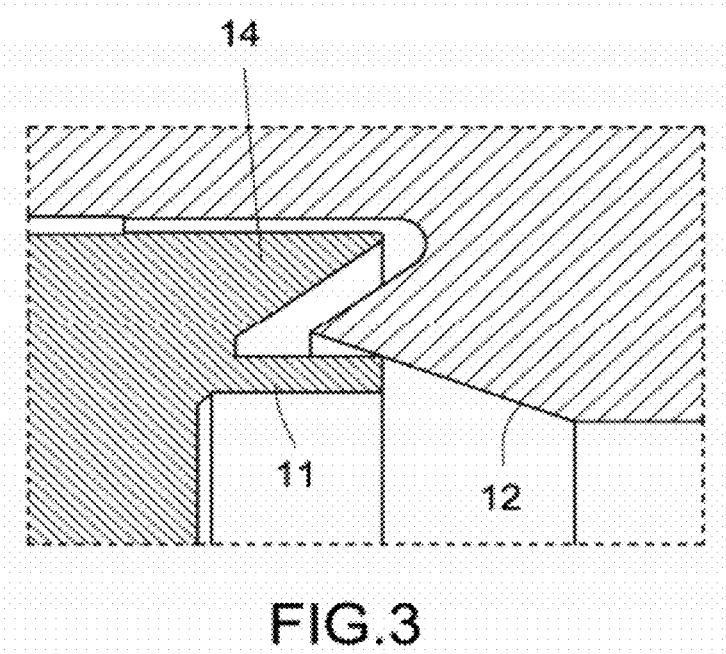
FIG. 3 shows an enlarged view of the area of FIG. 2 where the flange and the seating surface come into contact.

The flange (11) presses internally on the seating surface (12), as shown in FIGS. 2 and 3. In other words, the flange (11) is closer to the longitudinal axis (13) than the seating surface (12). A very interesting third effect is achieved with this: when the shot is fired, the high pressures generated inside the barrel (2) push the flange (11) against the seating surface (12) in its whole perimeter. As a result, the seal is strengthened in the moment when it is most needed, i.e. when the gunpowder explodes (7).

Preferably, the seating surface (12) on which the flange (11) presses forms an angle other than 90° with the longitudinal axis (13). This embodiment has been proven to multiply (supposing a constant torque setting) the normal force during the explosion between the seating surface (12) and the flange (11) by three. This performance (the sealing effect that does not allow gunpowder to pass) will be optimum the smaller the contact area between the flange (11) and the seating surface (12), because the smaller the contact area, the greater the pressure between the surfaces (supposing a constant normal force).

To ensure that the invention works correctly, it has been found that the flange (11) should have a reduced thickness, the aim being to guarantee a minimum flexibility (if it were completely rigid, it would not be tensioned and a seal would not be created, or alternatively the breech plug (1) would have to be screwed on very tightly to make it sufficiently tensioned, something that the user would find almost impossible). In consequence, the breech plug (1) preferably also comprises a protective projection (14) disposed externally to the flange (11) to protect the flange (11) from being damaged and possibly broken when the user is handling the breech plug while detaching the barrel. Said protective projection (14) is preferably an outer wall concentric to the flange (11), as shown in FIGS. 2 and 3.

Figure 4:
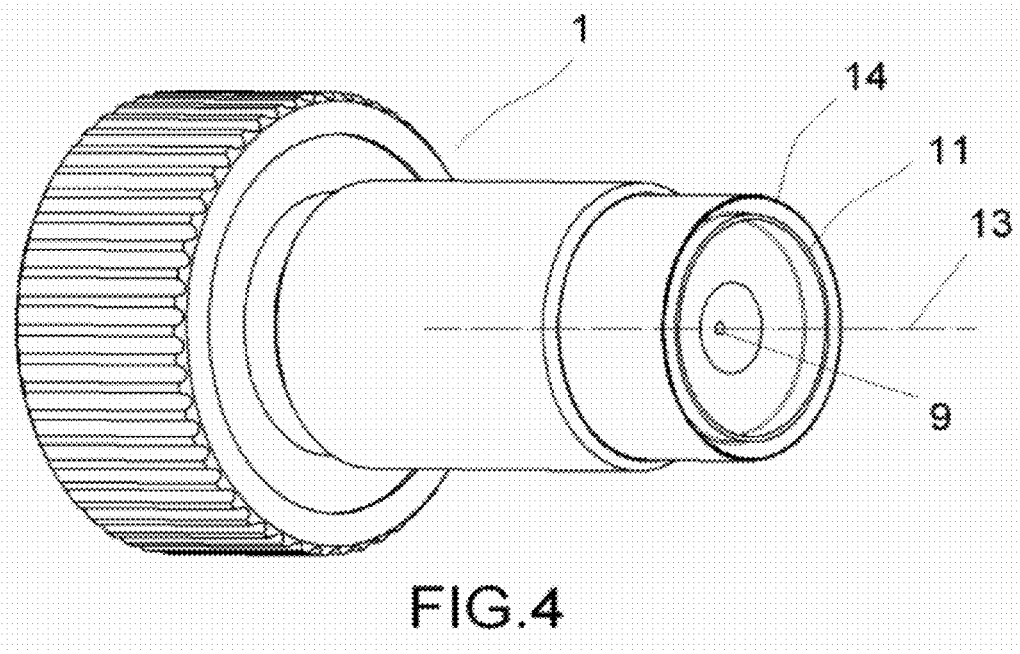
FIG. 4 shows a perspective view of the breech plug used in FIG. 2.

FIG. 4 shows a perspective view of the breech plug (1) used in FIG. 2. As can be seen, the breech plug (11) is continuous along the entire 360° around the longitudinal axis (13). The reduced thickness of the breech plug (11) can also be seen. As a result, it is interesting that the flange (11) is exteriorly protected by the protective projection (14).

The present invention provides for other embodiments different to those shown. For example, the connection between the breech plug (1) and the barrel (2) can be other than the threaded connection shown in the figures.

The invention claimed is:

1. A muzzle-loading rifle, comprising a breech plug and a barrel connected to each other through a connection area, wherein the breech plug comprises a first end further away from the part of the barrel designed to house a bullet and a second end closer to said part of the barrel, where the rifle is capable of firing the bullet in a shot direction, characterised in that:

the second end of the breech plug is provided with an integral continuous flange that sealably presses and tightens internally against a seating surface of the barrel when the breech plug is mounted in the interior of the barrel, wherein the breech plug and integral continuous flange comprise a unitary body;

wherein the breech plug comprises a protective projection disposed externally to the flange to protect the flange, and wherein the protective projection is an outer wall concentric to the flange.

2. A muzzle-loading firearm comprising:

a barrel having a muzzle end and a breech end with a bore extending through the barrel along a longitudinal axis, the breech end of the barrel comprising a connection area and an internal seating surface positioned circumferentially about the longitudinal axis of the barrel; and a breech plug for removable engagement within the connection area of the barrel, the breech plug comprising an integral continuous flange projecting therefrom for forming a continuous seal along the internal seating surface of the barrel, wherein the breech plug and integral continuous flange comprise a unitary body, and a seal is formed between the flange of the breech plug and the seating surface of the barrel when the breech plug is tightened within the barrel, wherein the breech plug further comprises a protective projection arranged externally and concentrically about the flange of the breech plug.

3. A muzzle-loading firearm comprising:

a barrel having a muzzle end and a breech end with a bore extending through the barrel along a longitudinal axis, the breech end of the barrel comprising a connection area and an internal seating surface positioned circumferentially about the longitudinal axis of the barrel; and a breech plug for removable engagement within the connection area of the barrel, the breech plug comprising an integral continuous flange projecting therefrom for forming a continuous seal along the internal seating surface of the barrel, wherein the breech plug and integral continuous flange comprise a unitary body, and a seal is formed between the flange of the breech plug and the seating surface of the barrel when the breech plug is tightened within the barrel, wherein the breech plug further comprises a protective projection arranged externally and concentrically about the flange of the breech plug, and wherein the barrel comprises a recess around the seating surface to receive the protective projection of the breech plug when assembled.

4. A breech plug for a muzzle-loading firearm, the breech plug comprising an integral flange projecting therefrom for continuous sealing contact with a seating surface, wherein the breech plug and the integral flange comprise a unitary body, and further comprising a protective projection arranged externally and concentrically about the flange.

* * * * *